United States Patent [19]

Siegrist

[11] 4,357,738

[45] Nov. 9, 1982

[54] CARD CLOTHING FOR CARDING MACHINES

[75] Inventor: Werner Siegrist, Jona, Switzerland

[73] Assignee: Graf & Cie. A.G., Rapperswil, Switzerland

[21] Appl. No.: 179,540

[22] Filed: Aug. 19, 1980

[30] Foreign Application Priority Data

May 29, 1980 [CH] Switzerland ..... 4200/80

[51] Int. Cl.[3] ..... D01G 15/84

[52] U.S. Cl. ..... 19/114

[58] Field of Search ..... 19/114

[56] References Cited

U.S. PATENT DOCUMENTS

| | | | |
|---|---|---|---|
| 1,095,978 | 5/1914 | Decker | 19/114 |
| 1,154,856 | 9/1915 | Graf | 19/114 |

FOREIGN PATENT DOCUMENTS

| | | | |
|---|---|---|---|
| 248643 | 9/1910 | Fed. Rep. of Germany | 19/114 |
| 262999 | 8/1912 | Fed. Rep. of Germany | 19/114 |
| 293546 | 3/1914 | Fed. Rep. of Germany | 19/114 |
| 293031 | 8/1914 | Fed. Rep. of Germany | 19/114 |
| 2052898 | 7/1973 | Fed. Rep. of Germany | 19/114 |

OTHER PUBLICATIONS

Federal German Engineering Standards; (DIN 64 108); p. 2.

*Primary Examiner*—Louis Rimrodt

*Attorney, Agent, or Firm*—Lane, Aitken, Kice & Kananen

[57] ABSTRACT

A card clothing for carding machines, including a plurality of flexible card wires, which card wires consist of staple shaped wire sections including each a pair of legs integrally connected to each other by the staple crown, which staple legs define the teeth and which staple crown defines the base web of each card wire section, which teeth define lanes extending in the direction of the flow of the material to be carded relative to the card clothing, and which card wires are inserted in a pattern-like arrangement into a card fillet. At least two relative to the direction of material flow consecutively arranged teeth are located relative to each other at a distance extending laterally to said direction of flow which does not exceed the prevailing wire gauge of said card wire. Accordingly, the card clothing comprises no free lanes. The pattern-like arranged teeth define groups arranged consecutively with regard to said material flow. A relatively to said direction of flow of the material trailing group of the several groups is displaced laterally with regard to said direction of flow of material relative to a preceding group.

6 Claims, 7 Drawing Figures

CARD CLOTHING FOR CARDING MACHINES

BACKGROUND OF THE INVENTION

1. Field of the Invention

The present invention relates to a card clothing for carding machines, including a plurality of flexible card wires, which card wires consist of staple shaped wire sections including each a pair of legs integrally connected to each other by the staple crown, which staple legs define the teeth and which staple crown defines the base web of each card wire section, which teeth define lanes extending in the direction of the flow of the material to be carded relative to the card clothing, and which card wires are inserted in a pattern-like arrangement into a card fillet. Carding machines belonging to the textile industry are used to expose or lay open, respectively, the individual fibres and to arrange these fibres to form a web or sliver, respectively, and specifically to clean the fibre material in case of a cotton spinning procedure. Such carding machines comprise generally a rotating carding cylinder and a plurality of flat bars, whereby the carding cylinder interacts with the flats to open and comb the fibres and to remove foreign matter thereform. To this end the jacket of the carding cylinder and the surfaces of the flats are provided with teeth, with upstanding wires, pins or needles. Generally the carding cylinder rotates and the flats move in the same direction as the carding cylinder but at different speeds.

2. Description of the Prior Art

Commonly known and standardized card clothing in rigid, half-rigid or flexible construction are set into the card fillets in pattern known as flat stitch, rib stitch or diagonal stitch. Seen in the direction of fibre flow these stitch patterns comprise lanes arranged evenly between the single teeth, which lanes can feature various widths, depending from the fineness of the card clothing, from the wire gauge of the card wire. The carding efficiency is influenced specifically when handling cotton. to a large extent by the width of the lanes. If lanes with a comparatively large width are present, neps will more easily glide between the respective teeth in comparison with a construction having relatively narrower lanes. Accordingly, efforts are made to arrive at as narrow lanes as possible. This is, however, not possible or limited, respectively, by the stitch patterns in accordance with the prior art; that is, it is not possible to design arbitrarily narrow lanes because such leads to a detrimental distribution of the teeth of the card clothing or alternatively, this would lead to the presence of a too small number of teeth per surface area unit. A too small number of teeth is also detrimental to the combing or carding, respectively, effect.

SUMMARY OF THE INVENTION

Hence, it is a general object of the present invention to provide an improved pattern of teeth of card clothing allowing an improved combing or carding, respectively, of the fibres.

Another object of this invention aims at the provision of a new and improved card clothing for carding machines, wherein at least two relative to the direction of fibre flow consecutively arranged teeth are located relative to each other at a distance measured perpendicularly to said direction of fibre flow which does not exceed the prevailing wire gauge of said card wire, such that said card clothing comprises no free lanes.

A further object is to provide a pattern of the teeth of a card clothing which allows an improved extraction of neps at a carding machine consisting of a rotating carding cylinder and a plurality of flat bars specifically for the presence of very fine nebs which cannot be opened with constructions of known prior art. A further object is to provide a card clothing which allows a better extraction of contaminations in the fibre sliver. A further object is to attain an improved parallelism of the individual fibres, may this be cotton fibres or synthetically fabricated fibres. Because a positive guiding of fibres can be attained with embodiments of the present invention a substantially higher parallelism of the card sliver can be arrived at.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
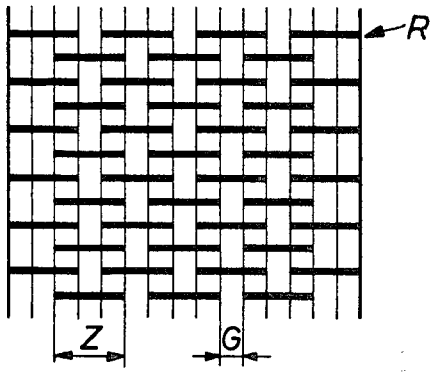
Fig.1 (PRIOR ART)
FIG. 1 is a view of a flat stitch in accordance with the prior art.
Figure 2:
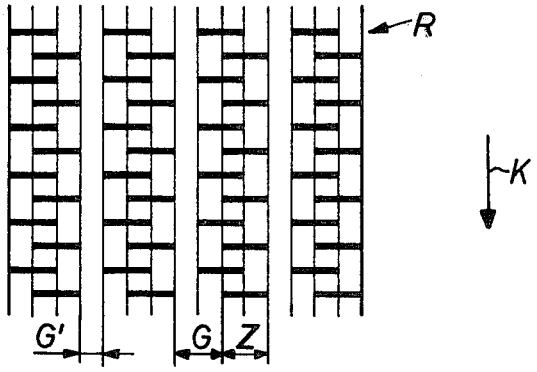
Fig.2 (PRIOR ART)
FIG. 2 is a view of a rib stitch of the prior art.
Figure 3:
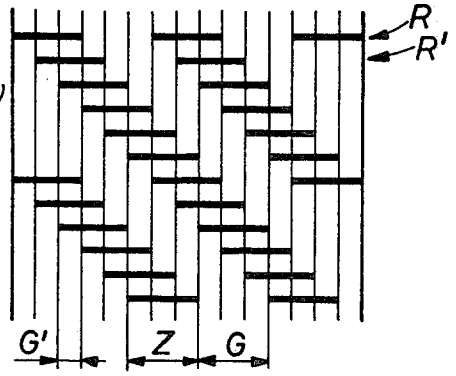
Fig.3 (PRIOR ART)
FIG.3 is a view of a diagonal stitch of the prior art.

Describing now the drawings, and considering initially FIG. 1, there is shown a flat stitch in accordance with DIN 64 108 (DIN=Federal German Engineering Standards). The teeth of any row R are distributed such that the width of the lanes G amounts to exactly $\frac{1}{3}$ of the tooth width, the width of the base web Z. The flow of fibre material is shown by means of the arrow K, which direction of flow is the same for all figures of the drawings. It is obvious that neps and other contaminants can slide through the lanes G, that is, between the teeth of the card clothing. In FIG. 2 there is shown a rib stitch in accordance with DIN 64 108, whereby the teeth of one row R are distributed such, that the width Z of the base web of the teeth equals the width of the lanes G, whereby, such as is shown at the left-hand side of FIG. 2, there exists a distinctly pronounced lane G'. In FIG. 3 there is shown the diagonal stitch in accordance with DIN 64 108. The teeth of any one row are distributed such, that the width of the base web of Z of the teeth equals the width of the lanes G. The teeth of every seen in direction of fibre flow trailing row R' are arranged staggered relative to the preceding row R by a distance amounting to $\frac{1}{3}$ of the width of the base web of the teeth. Furthermore, the left-side of FIG. 3 shows clearly that there are present three lanes G' which extend parallel to the direction of fibre flow indicated with the arrow K.

Figure 4:
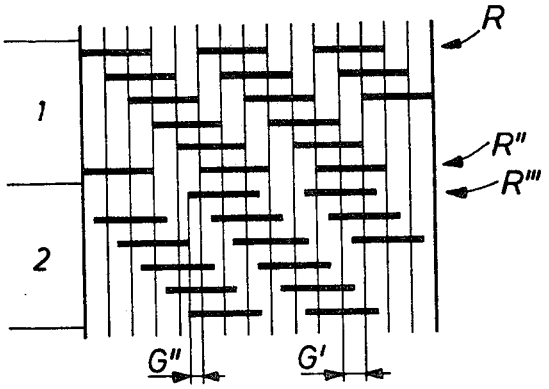
FIG. 4 is a view of a first embodiment of the invention, whereby there are shown two groups of teeth having an identical tooth pattern.

In FIG. 4 there is now shown a first embodiment of the invention. This card clothing comprises seen in direction of fibre flow, again indicated with the arrow K, several groups of card clothing, each group comprising a pattern of teeth, which groups are arranged consecutively seen in direction of fibre flow K. Thereby the group preceding relative to the direction of fibre flow is identified by the numeral 1, and the immediately trailing group is identified by the reference numeral 2. Both groups comprise the identical pattern of the arrangement of teeth, whereby the shown pattern is a diagonal stitch. The last row of teeth of mentioned preceding group 1 is defined by R'', and the first row of teeth of the trailing group 2 is defined by R'''. The teeth of the first row R''' of the trailing group 2 are displaced in a direction perpendicularly to the direction of fibre flow K relative to the teeth of the last row R'' of the preceding group 1 by a distance G''. In the embodiment shown in FIG. 4 this distance G'' amounts to exactly ½ of the distance G' which corresponds, neglecting the lateral displacement of the two succeeding groups, obviously to the lane G' of FIG. 3. Conclusively, with width of the lanes extending in the direction of fibre flow has been reduced by ½, corresponding to the distance identified by G'' in FIG. 4. Accordingly, the passing through of neps, contaminants, etc. is considerably reduced. If now the pattern is such that the dimension of the distance G'' is not larger than the prevailing wire gauge of the card wires, no free lane will exist at all. All individual groups 1, 2, etc. of this card clothing as shown in FIG. 4 comprise the same pattern of teeth. Hereby it must be noted that there obviously are several groups arranged at the card fillet, such that, seen in the direction of fibre flow, there may be any number from 6 to 10 such groups of identical tooth pattern.

Figure 5:
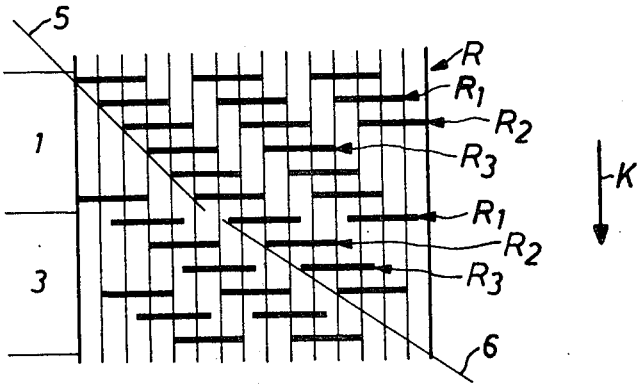
FIG. 5 shows a further embodiment, whereby the groups have each a different tooth pattern.

A further embodiment is shown in FIG. 5. Here each group comprises an own pattern of teeth differing at least from its preceding or trailing, respectively, group. Both groups 1 and 3 are shown to have teeth arranged in a pattern corresponding to the diagonal stitch. Thereby, the preceding group seen in direction of flow of the fibres comprises a certain pitch 5 of the displacement of the teeth of succeeding rows of teeth. The trailing group 3 comprises now a pitch 6 of the displacement of the teeth which differs from the pitch 5 of the preceding group insofar in that pitch 6 is smaller than pitch 5. Accordingly the teeth of immediately succeeding rows R1, R2, R3 of the trailing group 3 are displaced laterally to the direction of fibre flow K in comparison with the corresponding rows R1, R2, R3 of the preceding group. Accordingly this pattern, too, defines a smaller width of the lanes. One must now consider that the wire thickness, the wire gauge of the teeth is a certain dimension, this wire gauge may be for instance 1/5 of the width of the base web of the teeth such that it is obvious that by a consecutive arrangement of groups of varying teeth pattern it is possible to arrive at a card clothing which has no free lanes at all.

Figure 6:
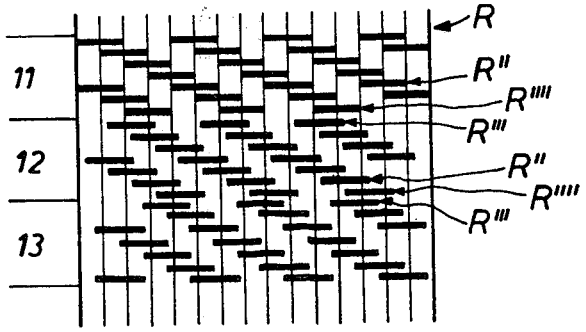
FIG. 6 is a view of a further embodiment of the invention executed in form of a diagonal stitch.

In FIG. 6 there is shown an embodiment which corresponds basically to the embodiment shown in FIG. 4. In FIG. 6 there are shown three groups, 11, 12, 13, having each the same pattern of teeth, whereby every group contains seven rows R of teeth. The teeth of every first row R''' of a group 12, 13, trailing relative to the direction of fibre flow K are laterally thereto displaced relative to any one row of teeth R'' of a corresponding previous group 11, 12 by a distance which at the most equals the thickness of the teeth, that is, the wire gauge of the prevailing card wire. Accordingly, no free lanes exist at all. It must be noted that the teeth of every first row of teeth R''' are displaced by a distance relative to the immediately preceding last row of teeth R'''' of the preceding group by a distance which is larger than the prevailing wire gauge. This arrangement prevents a rupturing of the card fillet at the area between two succeeding groups of teeth, being arranged staggered relative to each other as described above.

Figure 7:
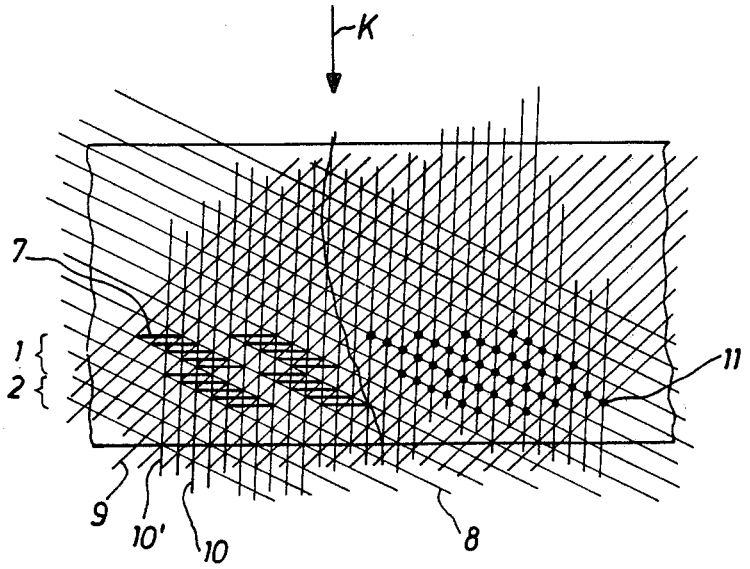
FIG. 7 is a view of a further embodiment of the invention showing a view of the front as well as of the back side of a flat showing the tooth pattern from the front as well as from the rear side.

In FIG. 7 there is shown a further embodiment of the invention. FIG. 7 shows again a displaced arrangement pattern in the diagonal stitch. The individual teeth of the card wires define three bands of parallel straight lines which intersect each other. Thereby following rule or teaching, respectively, can be seen. All individual teeth at the left end of any base web 7 of the teeth of a group 1 preceding relative to the direction of fibre flow K define together with the teeth at the right ends of the base webs of the teeth of the trailing group 2 a straight line 8 extending obliquely to the fibre flow K. Accordingly, all teeth define a band of parallel straight lines 8. However, all teeth define a further band of parallel straight lines 9 and yet a further band of parallel straight lines 10. All these straight lines extend obliquely to the direction of fibre flow K. Thereby specific attention shall be paid to the fact that the straight lines 10 clearly identified by the line 10' connect two succeeding teeth relative to the direction of fibre flow K of the two succeeding groups and extends such obliquely to the direction of fibre flow K that these teeth referred to are arranged laterally displaced relative to each other by a distance which amounts to not more of the wire gauge of the prevailing card wire. Again this arrangement of patterns leaves no free lanes. The left-hand side of FIG. 7 is drawn in accordance with DIN 64 108, that is, the base webs of the teeth are depicted. The right-hand side of FIG. 7 shows a view of the opposite side of the card fillet. Accordingly, a pattern-like arrangement of all single teeth 11 is shown. Thereby, one may note specifically that the pattern arrived at and shown in FIG. 7 is a uniform pattern.

The displaced arrangement of two succeeding groups accroding to FIG. 6 and to FIG. 7 follows a further teaching. According to the prevailing standards several diagonal stitches exist. These are identified by a numeral. There are known for instance a 4-diagonal stitch and a 6-diagonal stitch. The 4-diagonal stitch is characterized in that any second row of teeth is relative to the direction of fibre flow K displaced relative to the first row by a distance amounting to ½ of the extent of the base web of the teeth, whereby this distance is defined as (e/2). This distance corresponds to the width of the lanes G (see FIGS. 1–4). The six-diagonal stitch is characterized, in that the second row of teeth is displaced laterally to the first row by a distance of ⅓ of the base web length (e/3). The distance of lateral displacement corresponds again to the width of the lanes G. Accordingly, the teaching of FIGS. 6 and 7 of the embodiment of the present invention obeys following rule: The teeth of the first row of a second or trailing group are arranged laterally displaced with regard to the teeth of the last row of a first or preceding, respectively, group by a distance which is larger than $(2/n) \times$ width of lanes. Accordingly, if the stitch patterns are diagonal stitches, this means that said lateral displacement amounts by a 4-diagonal stitch to more than ½ width of lane, by a 6-diagonal stitch more than ⅓ width of lane, by an 8-diagonal stitch more than ¼ width of lane. Thereby, the width of lane is defined as the lane defined by one only row of teeth. Conclusively, the rule of an n-diagonal stitch teaches that the lateral distance is larger than 1/n/2 width of lane which can be expressed as larger than (2/n)×width of lane.

While there are shown and described present preferred embodiments of the invention, it is to be distinctly understood that the invention is not limited thereto, but may be otherwise variously embodied and practiced within the scope of the following claims. Accordingly,

What is claimed is:

1. A card clothing for carding machines, including a plurality of flexible card wires consisting of staple shaped wire sections of a predetermined wire gauge and each including a pair of legs integrally connected to each other by the staple crown, said legs defining teeth and said staple crown defining the base web of each card wire section, said teeth defining lanes extending in the direction of the flow of the fibers to be carded relative to the card clothing, said card wires being disposed in a pattern-like arrangement into a card fillet, said teeth being arranged in a plurality of groups arranged consecutively relative to said direction of fiber flow, each group comprising a plurality of rows of teeth in a diagonal stitch pattern with each row of teeth defining a line extending perpendicularly to said direction of fiber flow, a given row of teeth in one group being displaced relative to a given row of teeth in another group in said direction of fiber flow, a distance measured perpendicularly to said direction of fiber flows which does not exceed said wire gauge, such that said card clothing comprises no free lanes.

2. A card clothing for carding machines, including a plurality of flexible card wires consisting of staple shaped wire sections including a pair of legs integrally connected to each other by the staple crown, said legs defining teeth and said staple crown defining the base web of each card wire section, said teeth defining lanes extending in the direction of the flow of the fibers to be carded relative to the card clothing, said card wires being disposed in a pattern-like arrangement into a card fillet, said teeth being arranged in a plurality of groups arranged consecutively relative to said direction of fiber flow, each group comprising a plurality of rows of teeth with each row of teeth defining a line extending perpendicularly to said direction of fiber flow, said teeth being arranged in a diagonal stitch pattern, with the pitch of the displacement of the teeth of at least one group differing from the pitch of the displacement of another group.

3. A card clothing for carding machines, including a plurality of flexible card wires consisting of staple shaped wire sections of a predetermined wire gauge and each including a pair of legs integrally connected to each other by the staple crown, said legs defining teeth and said staple crown defining the base web of each card wire section, said teeth defining lanes extending in the direction of the flow of the fibers to be carded relative to the card clothing, said card wires being disposed in a pattern-like arrangement into a card fillet, said teeth being arranged in a plurality of groups arranged consecutively relative to said direction of fiber flow, each group comprising a plurality of rows of teeth arranged in a diagonal stitch pattern with each row of teeth defining a line extending perpendicularly to said direction of fiber flow, the teeth of the first row of teeth of a trailing group relative to said direction of fiber flow being displaced in a direction perpendicular to said direction of fiber flow relative to the teeth of the last row of the immediately preceding group by a distance which does not exceed said wire gauge.

4. A card clothing for carding machines, including a plurality of flexible card wires consisting of staple shaped wire sections including a pair of legs integrally connected to each other by the staple crown, said legs defining teeth and said staple crown defining the base web of each card wire section, said teeth defining lanes extending in the direction of the flow of the fibers to be carded relative to the card clothing with the length of said base web equalling the width of said lane, said wires being disposed in a pattern-like arrangement into a card fillet, said teeth being arranged in a plurality of groups having the same teeth pattern and arranged consecutively relative to said direction of fiber flow, each group comprising a plurality of rows of teeth arranged in a diagonal stitch pattern with each row of teeth defining a line extending perpendicularly to said direction of fiber flow, said teeth being located at the points of intersection of a net defined by a plurality of mutually intersecting series of straight lines, whereby at least two series of said straight lines extend at an oblique angle relative to said direction of fiber flow.

5. A card clothing for carding machines, including a plurality of flexible card wires consisting of staple shaped wire sections including a pair of legs integrally connected to each other by the staple crown, said legs defining teeth and said staple crown defining the base web of each card wire section, said teeth defining lanes extending in the direction of the flow of the fibers to be carded relative to the card clothing, said card wires being disposed in a pattern-like arrangement into a card fillet, said teeth being arranged in a plurality of groups having the same teeth pattern, with consecutive groups being staggered relative to each other in the direction of fiber flow, each group comprising a plurality of rows of teeth arranged in a diagonal stitch pattern with each row of teeth defining a line extending perpendicularly to said direction of fiber flow, all single teeth located at one end of the respective base webs of a preceding group defining a straight line extending through the single teeth located at the corresponding opposite end of the respective base webs of a trailing group.

6. A card clothing for carding machines, including a plurality of flexible card wires consisting of staple shaped wire sections including a pair of legs integrally connected to each other by the staple crown, said legs defining teeth and said staple crown defining the base web of each card wire section, said teeth defining lanes extending in the direction of the flow of the fibers to be carded relative to the card clothing, said wires being disposed in a pattern-like arrangement into a card fillet, said teeth being arranged in a plurality of groups having the same teeth pattern and arranged consecutively relative to said direction of fiber flow, each group comprising a plurality of rows of teeth arranged in an n-diagonal stitch pattern, wherein the teeth of the first row of a trailing group are displaced relative to the teeth of the last row of the immediately preceding group by a distance larger than (2/n)×width of said lane.

* * * * *